US011075041B2

(12) United States Patent
Kamijima et al.

(10) Patent No.: US 11,075,041 B2
(45) Date of Patent: Jul. 27, 2021

(54) MAGNETICALLY ACTUATED MEMS SWITCH

(71) Applicant: TDK CORPORATION, Tokyo (JP)

(72) Inventors: Akifumi Kamijima, Tokyo (JP); Atsushi Iijima, Tokyo (JP); Kyung-Ku Choi, Tokyo (JP); Katsunori Osanai, Tokyo (JP); Daisuke Iwanaga, Tokyo (JP)

(73) Assignee: TDK CORPORATION, Tokyo (JP)

( * ) Notice: Subject to any disclaimer, the term of this patent is extended or adjusted under 35 U.S.C. 154(b) by 199 days.

(21) Appl. No.: 16/377,418

(22) Filed: Apr. 8, 2019

(65) Prior Publication Data

US 2019/0318893 A1 Oct. 17, 2019

(30) Foreign Application Priority Data

Apr. 11, 2018 (JP) ..... JP2018-076145

(51) Int. Cl.

| | |
|---|---|
| ***H01H 51/22*** | (2006.01) |
| ***H01H 47/00*** | (2006.01) |
| ***H01H 50/00*** | (2006.01) |
| ***H01H 50/44*** | (2006.01) |
| ***H01H 50/64*** | (2006.01) |
| ***H01H 50/36*** | (2006.01) |
| ***H01H 50/54*** | (2006.01) |
| ***H01H 50/18*** | (2006.01) |

(52) U.S. Cl.

CPC ..... *H01H 47/001* (2013.01); *H01H 50/005* (2013.01); *H01H 50/18* (2013.01); *H01H 50/36* (2013.01); *H01H 50/44* (2013.01); *H01H 50/54* (2013.01); *H01H 50/645* (2013.01)

(58) Field of Classification Search

CPC ..... H01H 50/005
USPC ..... 335/78, 185
See application file for complete search history.

(56) References Cited

U.S. PATENT DOCUMENTS

| | | | | |
|---|---|---|---|---|
| 5,430,421 | A * | 7/1995 | Bornand | H01H 1/0036 335/151 |
| 5,818,316 | A | 10/1998 | Shen et al. | |
| 5,889,452 | A | 3/1999 | Vuilleumier | |
| 6,040,749 | A | 3/2000 | Youngner et al. | |
| 6,124,650 | A * | 9/2000 | Bishop | H01H 50/005 310/40 MM |
| 6,366,186 | B1 | 4/2002 | Hill et al. | |

(Continued)

FOREIGN PATENT DOCUMENTS

| | | | |
|---|---|---|---|
| JP | 2008-262863 | A | 10/2008 |
| JP | 2009-134993 | A | 6/2009 |

*Primary Examiner* — Alexander Talpalatski
(74) *Attorney, Agent, or Firm* — Oliff PLC

(57) ABSTRACT

A magnetically actuated MEMS switch 100 includes a first magnetic core portion 120, a first signal line 15, a first contact point 16, a second magnetic core portion 220, a second signal line 25, a second contact point 26, and a first coil portion 111 and a second coil portion 211 serving as a magnetic field applying portion that causes a current to flow in conductor coil to apply a magnetic field to the first magnetic core portion 120 and the second magnetic core portion 220. The first contact point 16 is displaced depending on the presence or absence of a magnetic field applied by the magnetic field applying portion. Connection and disconnection between the first contact point 16 and the second contact point 26 are switched in response to displacement of the first contact point 16.

8 Claims, 7 Drawing Sheets

(56) References Cited

U.S. PATENT DOCUMENTS

| | | | | |
|---|---|---|---|---|
| 6,621,390 | B2 * | 9/2003 | Song | H01H 59/0009 200/181 |
| 6,633,212 | B1 | 10/2003 | Ruan et al. | |
| 6,813,133 | B2 * | 11/2004 | Yasuoka | H01H 59/0009 335/78 |
| 7,042,319 | B2 * | 5/2006 | Ishiwata | H01F 7/08 335/296 |
| 7,215,229 | B2 * | 5/2007 | Shen | H01H 59/0009 200/181 |
| 7,839,242 | B1 | 11/2010 | Hopper et al. | |
| 8,451,077 | B2 * | 5/2013 | Luce | H01H 11/00 335/78 |
| 8,957,747 | B2 * | 2/2015 | Wilson | H01H 50/005 335/78 |
| 9,076,619 | B2 * | 7/2015 | Page | H01H 49/00 |
| 2006/0049900 | A1 | 3/2006 | Ruan et al. | |
| 2006/0197635 | A1 | 9/2006 | Christenson | |
| 2008/0061911 | A1 * | 3/2008 | Bolle | H01H 37/761 335/78 |
| 2008/0092367 | A1 | 4/2008 | Hsu et al. | |
| 2010/0007448 | A1 | 1/2010 | Niblock | |
| 2010/0171575 | A1 | 7/2010 | Min et al. | |
| 2010/0171577 | A1 | 7/2010 | Christenson | |
| 2010/0295638 | A1 | 11/2010 | Hopper et al. | |
| 2011/0140814 | A1 | 6/2011 | Christenson | |

* cited by examiner

MAGNETICALLY ACTUATED MEMS SWITCH

TECHNICAL FIELD

The present invention relates to a magnetically actuated MEMS switch.

BACKGROUND

In the related art, switching devices using a micro electromechanical system (MEMS) are known. As such a switching device, a magnetically actuated MEMS switch which is opened and closed depending on the presence or absence of magnetism has been examined. For example, Japanese Unexamined Patent Publication No. 2009-134993 discloses an MEMS switch in which a magnetic force is applied to a magnetic material such that the magnetic material is warped, and a first contact point provided in the magnetic material and a second contact point disposed to face the first contact point come into contact with each other. Japanese Unexamined Patent Publication No. 2009-134993 discloses a configuration in which a magnet is moved in the vicinity of an MEMS switch such that a magnetic force is applied to a magnetic material.

SUMMARY

However, in order to realize an MEMS switch disclosed in Japanese Unexamined Patent Publication No. 2009-134994, there is a need to provide a mechanism of moving a magnet in the vicinity of the MEMS switch, so that a device configuration for realizing the MEMS switch is increased in size. In addition, in MEMS switches, high-speed switching and sticking between contact points have been problems in the related art, and amelioration thereof is also expected.

The present invention has been made in consideration of the foregoing circumstances, and an object thereof is to provide a magnetically actuated MEMS switch in which miniaturization, fast switching, and resolving of sticking between contact points are realized.

In order to achieve the foregoing object, according to the present invention, there is provided a magnetically actuated MEMS switch including a first magnetic core portion, a first signal line that is provided in the first magnetic core portion, a first contact point that is fixed to one end of the first magnetic core portion and is electrically connected to the first signal line, a second magnetic core portion, a second signal line that is provided in the second magnetic core portion, a second contact point that is fixed to one end of the second magnetic core portion and is electrically connected to the second signal line, and a magnetic field applying portion that includes a conductor coil and causes a current to flow such that a magnetic field is applied to the first magnetic core portion and the second magnetic core portion. The first contact point is displaced depending on the presence or absence of a magnetic field applied by the magnetic field applying portion. Connection and disconnection between the first contact point and the second contact point are switched in response to displacement of the first contact point.

According to the magnetically actuated MEMS switch described above, since the magnetic field applying portion including a conductor coil controls a magnetic field applied to the first magnetic core portion and the second magnetic core portion, the first contact point is displaced, so that connection and disconnection between the first contact point fixed to the first magnetic core portion and the second contact point fixed to the second magnetic core portion are switched. Therefore, even if a mechanism or the like for moving an external magnet is not provided, connection and disconnection between the first contact point and the second contact point can be controlled, so that miniaturization can be realized. In addition, since applying of a magnetic field with respect to the first contact point and the second contact point can be switched at a high speed, fast switching can be realized. Moreover, since applying and blocking of a magnetic field with respect to the first magnetic core portion and the second magnetic core portion can be forcibly switched, even if sticking has occurred between the first contact point and the second contact point, resolving of sticking can be promoted by controlling a magnetic field.

Here, according to the aspect of the invention, the first magnetic core portion may include a flexible magnetic core portion that is provided between the one end to which the first contact point is fixed and the other end opposite to the one end, and that has flexibility with respect to an external force in a direction in which the one end intersects an extending direction of the one end.

As described above, since the first magnetic core portion includes a flexible magnetic core portion that is provided between both end portions and has flexibility, when one end, to which the first contact point is fixed, is displaced due to a magnetic field applied by the magnetic field applying portion, the other end can be prevented from being displaced in response to this displacement. Therefore, for example, the degree of freedom of disposition or the like for the magnetically actuated MEMS switch can be enhanced.

In addition, according to the aspect of the invention, the second contact point may be displaced depending on the presence or absence of a magnetic field applied by the magnetic field applying portion, and connection and disconnection between the first contact point and the second contact point may be switched in response to displacement of the first contact point and the second contact point.

As described above, according to a configuration in which the second contact point of a magnetic field is displaced and connection and disconnection between the first contact point and the second contact point are switched in response to displacement of the first contact point and the second contact point, even if a displacement amount of each of the first contact point and the second contact point is small, connection and disconnection between the first contact point and the second contact point can be switched. Therefore, even when the magnitude of a magnetic field to be applied to the first magnetic core portion and the second magnetic core portion is reduced, connection and disconnection between the first contact point and the second contact point can be favorably switched. In addition, since connection and disconnection between the first contact point and the second contact point can be switched while the displacement amount of each of the first contact point and the second contact point is reduced, faster switching can be realized.

In addition, according to the aspect of the invention, the second magnetic core portion may include a flexible magnetic core portion that is provided between the one end to which the second contact point is fixed and the other end opposite to the one end, and that has flexibility with respect to an external force in a direction in which the one end intersects an extending direction of the one end.

As described above, since the second magnetic core portion includes a flexible magnetic core portion that is provided between both end portions and has flexibility, when one end, to which the second contact point is fixed, is displaced due to a magnetic field applied by the magnetic field applying portion, the other end can be prevented from being displaced in response to this displacement. Therefore, for example, the degree of freedom of disposition or the like for the magnetically actuated MEMS switch can be enhanced.

According to the aspect of the invention, the first contact point and the second contact point may be separated from each other when there is no magnetic field applied by the magnetic field applying portion and may be electrically connected to each other when there is a magnetic field applied by the magnetic field applying portion.

According to the aspect of the invention, the first contact point and the second contact point may be separated from each other when there is a magnetic field applied by the magnetic field applying portion and may be electrically connected to each other when there is no magnetic field applied by the magnetic field applying portion.

According to the aspect of the invention, the first magnetic core portion may function as the first signal line, or the first signal line and the first contact point. In such a configuration, even if the first signal line, or the first signal line and the first contact point are not separately provided, the function as an MEMS switch can be realized.

In addition, according to the aspect of the invention, the second magnetic core portion may function as the second signal line, or the second signal line and the second contact point. In such a configuration, even if the second signal line, or the second signal line and the second contact point are not separately provided, the function as an MEMS switch can be realized.

According to the present invention, there is provided a magnetically actuated MEMS switch in which miniaturization, fast switching, and resolving of sticking between contact points are realized.

DETAILED DESCRIPTION

Hereinafter, with reference to the accompanying drawings, a preferred embodiment of the present invention will be described in detail. In description of the drawings, the same reference signs are applied to the same elements, and duplicated description will be omitted.

Figure 1:
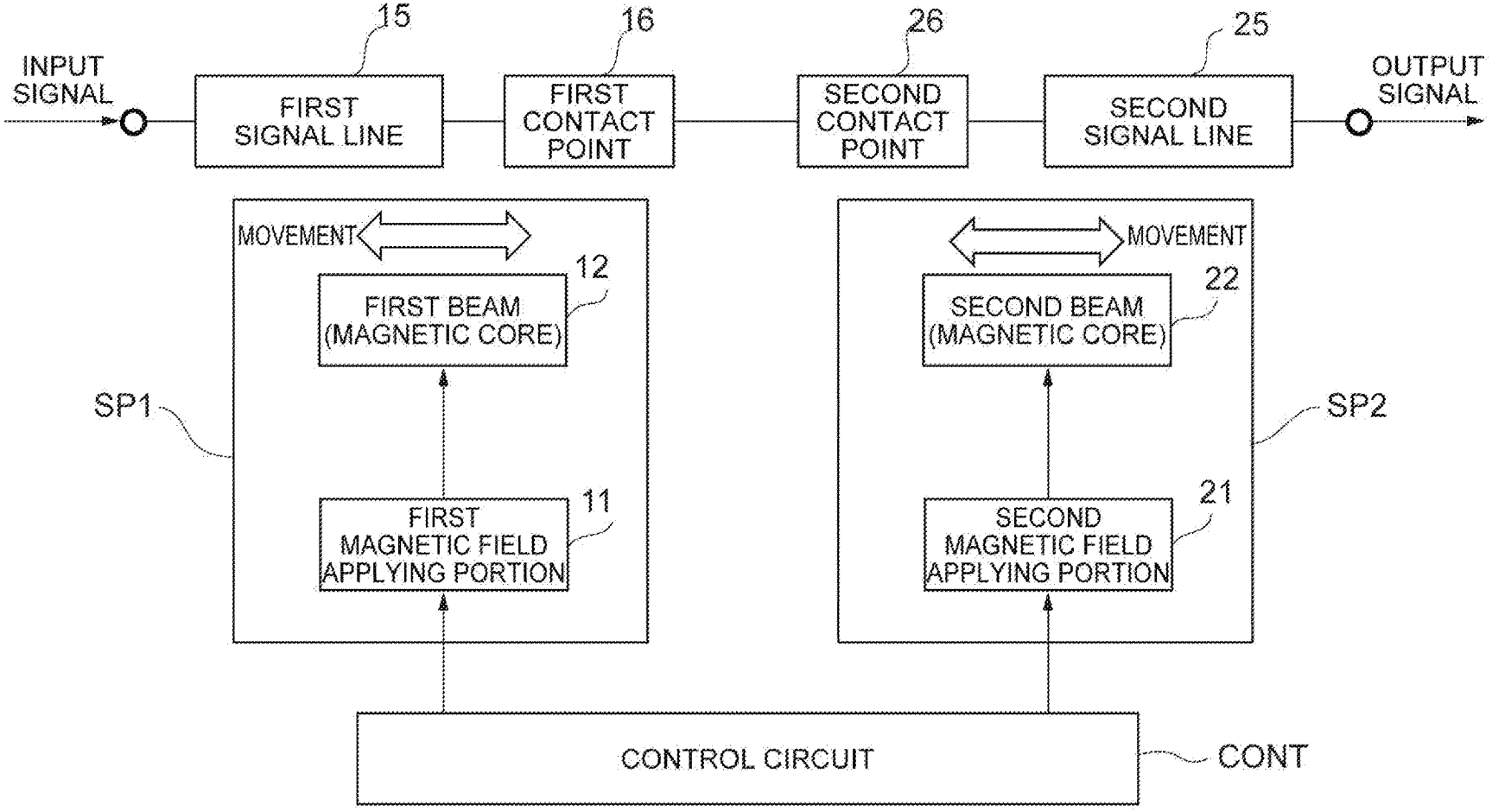
FIG. 1 is a view illustrating a schematic configuration of a magnetically actuated MEMS switch.

FIG. 1 is a view illustrating a schematic configuration of a magnetically actuated MEMS switch. A magnetically actuated MEMS switch 100 is a kind of a so-called high-frequency switch (RF switch) and is a device performing mechanical switching by utilizing a change in a magnetic field.

As illustrated in FIG. 1, the magnetically actuated MEMS switch 100 is configured to include a first driving unit SP1, a first signal line 15, a first contact point 16, a second driving unit SP2, a second signal line 25, and a second contact point 26. The first driving unit SP1 is configured to include a first magnetic field applying portion 11 (magnetic field applying portion) and a first beam 12. The second driving unit SP2 is configured to include a second magnetic field applying portion 21 (magnetic field applying portion) and a second beam 22.

Each of the first signal line 15 and the second signal line 25 is constituted of a conductor such as copper (Cu). In addition, each of the first contact point 16 and the second contact point 26 is constituted of a conductor such as gold (Au), tungsten (W), molybdenum (Mo), or diamond-like carbon (DLC). However, it is preferable that the first contact point 16 and the second contact point 26 be a metal which has a high melting point, has spreadability, has abrasion resistance, and is formed of a material different from those of the first beam 12 and the second beam 22 (which will be described below). In the magnetically actuated MEMS switch 100, a signal input from outside is guided via the first signal line 15 and the second signal line 25 and is output to the outside through the second signal line 25 as an output signal. Connection and disconnection are switched between the first signal line 15 and the second signal line 25 due to the first contact point 16 connected to the first signal line 15 and the second contact point 26 connected to the second signal line. While the first contact point 16 and the second contact point 26 are in contact with each other, the first signal line 15 and the second signal line 25 are electrically connected (ON) to each other through connection between the first contact point 16 and the second contact point 26. While the first contact point 16 and the second contact point 26 are separated from each other, the first contact point 16 and the second contact point 26 are disconnected from each other, so that the first signal line 15 and the second signal line 25 are electrically disconnected from each other (OFF). In the embodiment described below, a case in which the first contact point 16 and the second contact point 26 come into contact with each other will be described. However, electrical connection between the first signal line 15 and the second signal line need only be realized due to contact between the first contact point 16 and the second contact point 26. Therefore, the first contact point 16 and the second contact point 26 do not have to be in contact with each other and need only be at least electrically connected to each other. For example, another conductor material or the like may be configured to be interposed between the first contact point 16 and the second contact point 26 such that the first contact point 16 and the second contact point 26 can be electrically connected to each other via the conductor material.

Connection and disconnection between the first contact point 16 and the second contact point 26 are switched in response to a physical movement of the first contact point 16 and the second contact point 26 (or only the first contact point 16).

Both the first beam 12 and the second beam 22 are formed of a magnetic material (soft magnetic material) and function as a magnetic core. Examples of a soft magnetic material forming the first beam 12 and the second beam 22 include iron, nickel, cobalt, an alloy having these metals as main compositions, and ferrite, but the material is not limited thereto. The first driving unit SP1 magnetizes the first beam 12 due to a magnetic field applied by the first magnetic field applying portion 11. The first magnetic field applying portion 11 is configured to include a coil (conductor coil) formed of a conductor material wound around the first beam 12. In addition, the second driving unit SP2 magnetizes the second beam 22 due to a magnetic field applied by the second magnetic field applying portion 21. The second magnetic field applying portion 21 is configured to include a coil formed of a conductor material wound around the second beam 22. Each of the coil of the first magnetic field applying portion 11 and the coil of the second magnetic field applying portion 21 is connected to a power supply (not illustrated).

The first beam 12 and the second beam 22 are disposed in a state in which one ends thereof are close to each other. An end portion of the first beam 12 disposed to be close to the second beam 22 is an end portion in which one polarity is manifested when being magnetized by the first magnetic field applying portion 11. The first contact point 16 connected to the first signal line 15 is provided in this end portion of the first beam 12.

In addition, an end portion of the second beam 22 disposed to be close to the first beam 12 is an end portion in which one polarity is manifested when being magnetized by the second magnetic field applying portion 21. The second contact point 26 connected to the second signal line 25 is provided in this end portion of the second beam 22.

Based on a signal from a control circuit CONT, a current flows from a power supply (not illustrated) to the first magnetic field applying portion 11 and the second magnetic field applying portion 21, such that magnetization/magnetization loss of the first beam 12 by the first magnetic field applying portion 11 and magnetization/magnetization loss of the second beam 22 by the second magnetic field applying portion 21 are controlled. If the end portion of the first beam 12 and the end portion of the second beam 22 disposed to be close to each other are magnetized to have polarities different from each other due to magnetization of the first beam 12 and the second beam 22, the first beam 12 and the second beam 22 attract each other. As a result, the first contact point 16 attached to the first beam 12 and the second contact point 26 attached to the second beam 22 are connected to each other. In addition, if the first beam 12 and the second beam 22 lose magnetization, the first beam 12 and the second beam 22 are separated from each other, and the first contact point 16 and the second contact point 26 are disconnected from each other.

The magnetically actuated MEMS switch 100 described above may be sealed by a package having a hollow structure formed of a resin or the like, while retaining the degree of freedom of a movable part.

Figure 2:
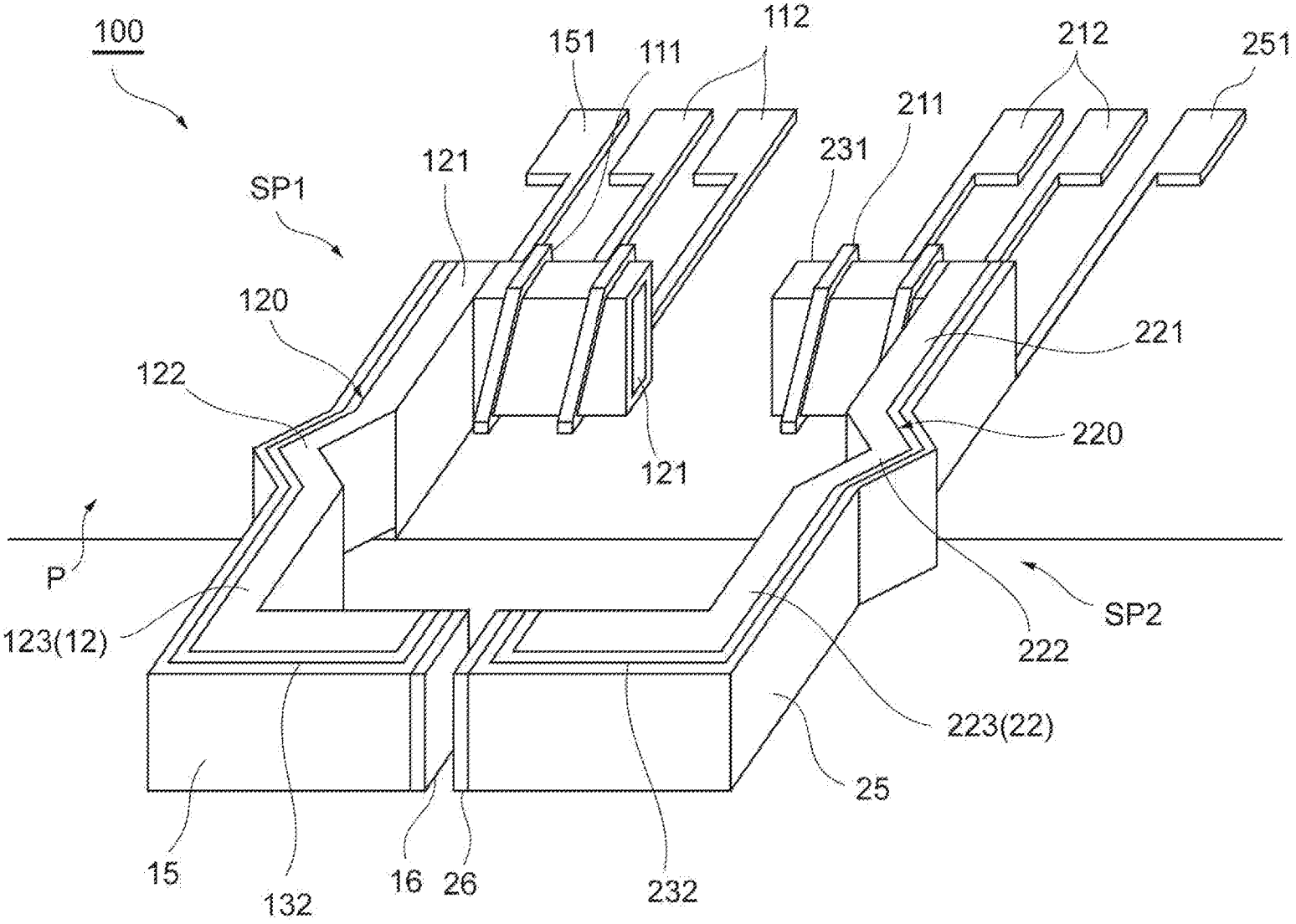
FIG. 2 is a perspective view of the magnetically actuated MEMS switch.

Next, a specific structure of the magnetically actuated MEMS switch 100 illustrated in FIG. 1 will be described with reference to FIG. 2. FIG. 2 is a perspective view of the magnetically actuated MEMS switch 100. FIG. 2 illustrates a state in which the magnetically actuated MEMS switch 100 is attached to an upper portion of a circuit board P. The first driving unit SP1 and the second driving unit SP2 of the magnetically actuated MEMS switch 100 are attached to the upper portion of the circuit board P and are disposed to face each other.

The first driving unit SP1 includes a first magnetic core portion 120 which includes the first beam 12 and the first magnetic field applying portion 11 which applies a magnetic field to the first magnetic core portion 120. In addition, the first contact point 16 is attached to one end portion (one end) of the first beam 12, and the first signal line is electrically connected to the first contact point 16.

The first magnetic core portion 120 includes a fixed magnetic core portion 121 which is fixed to the circuit board P, a flexible magnetic core portion 122 which is continuously provided with respect to the fixed magnetic core portion 121 and is not fixed to the circuit board P, and a movable magnetic core portion 123 which is continuously provided with respect to the flexible magnetic core portion 122 and is not fixed to the circuit board P. Among these, the movable magnetic core portion 123 becomes the first beam 12 which moves in response to magnetization/magnetization loss.

The fixed magnetic core portion 121 and the movable magnetic core portion 123 have substantially an L-shape. A magnetic core portion of the flexible magnetic core portion 122 provided between the fixed magnetic core portion 121 and the movable magnetic core portion 123 (disposed near the center of the first magnetic core portion 120 in a longitudinal direction) is subjected to bending. The flexible magnetic core portion 122 has a shape which can be warped when the movable magnetic core portion 123 of the first magnetic core portion 120 receives an external force in a direction intersecting an extending direction thereof. Therefore, even when the movable magnetic core portion 123 which can freely move with respect to the circuit board P moves, the flexible magnetic core portion 122 regulates the fixed magnetic core portion 121 moving in response to the movement thereof. The shapes of the fixed magnetic core portion 121, the flexible magnetic core portion 122, and the movable magnetic core portion 123 are not limited to those illustrated in FIG. 2 and can be suitably changed.

The length of the first magnetic core portion 120 in the longitudinal direction (direction in which the fixed magnetic core portion 121, the flexible magnetic core portion 122, and the movable magnetic core portion 123 are arranged) is set within a range of approximately 100 μm to 1 mm, for example. The width (length in a direction perpendicular to a surface of the circuit board P in FIG. 2) is set within a range of approximately 5 μm to 100 μM, for example. The thickness (length in a direction parallel to the surface of the circuit board P in FIG. 2) is set within a range of approximately 1 μm to 10 μm, for example.

An insulator 131 partially covers a portion around the fixed magnetic core portion 121. In addition, a first coil portion 111 formed of a conductor such as copper (Cu) is provided on an outer side of the insulator 131 in a manner of being wound around the fixed magnetic core portion 121. In the magnetically actuated MEMS switch 100, the first coil portion 111 is wound around the fixed magnetic core portion 121 twice. However, the number of winding of the first coil portion 111 can be suitably changed. Both end portions of the first coil portion 111 serve as a conductor pad 112, which can be connected to a circuit or the like of the circuit board P. The thickness of the insulator 131 (length from an inner circumferential surface to an outer circumferential surface) is set within a range of approximately 1 μm to 10 μm, for example.

The first contact point 16 is provided in an end portion of the movable magnetic core portion 123 on one side (one end: an end portion on a side opposite to the other end which is the end portion on the flexible magnetic core portion 122 side). The size of the first contact point 16 is set within a range of approximately 5 square μm to 100 square μm, for example.

The first signal line 15 extends along the fixed magnetic core portion 121, the flexible magnetic core portion 122, and the movable magnetic core portion 123 and is provided to be electrically connected to the first contact point 16. In the case of the magnetically actuated MEMS switch 100, the first signal line 15 is provided along the outer side of the first magnetic core portion 120 (side opposite to a side facing the second driving unit SP2). The end portion of the first signal line 15 (end portion on a side opposite to the end portion on the first contact point 16 side) serves as a conductor pad 151, to which a circuit or the like of the circuit board P can be connected. An insulator 132 is provided between the first signal line 15 and the first magnetic core portion 120 and between the first contact point 16 and the first magnetic core portion 120 (movable magnetic core portion 123). The first signal line 15 and the first contact point 16 are electrically insulated from the first magnetic core portion 120. The thickness of the insulator 132 (length in a direction parallel to the surface of the circuit board P in FIG. 2) is set within a range of approximately 1 μm to 10 μm, for example. The first signal line 15 is disposed to avoid a position at which the first coil portion 111 is provided. However, the first signal line 15 may be wired such that the first coil portion 111 is wound around the first signal line 15. In addition, disposition of the first signal line 15 can be suitably changed. For example, the first signal line 15 may be wired on the inner side of the first magnetic core portion 120 (side facing of the second driving unit SP2).

In the first driving unit SP1, the first coil portion 111 functions as the first magnetic field applying portion 11 which causes magnetization/magnetization loss of the first magnetic core portion 120 including the movable magnetic core portion 123 which functions as the first beam 12.

The second driving unit SP2 includes a second magnetic core portion 220 which includes the second beam 22 and the second magnetic field applying portion 21 which applies a magnetic field to the second magnetic core portion 220. In addition, the second contact point 26 is attached to the end portion of the second beam 22, and the second signal line 25 is electrically connected to the second contact point 26.

The second magnetic core portion 220 includes a fixed magnetic core portion 221 which is fixed to the circuit board P, a flexible magnetic core portion 222 which is continuously provided with respect to the fixed magnetic core portion 221, and a movable magnetic core portion 223 which is continuously provided with respect to the flexible magnetic core portion 222 and is not fixed to the circuit board P. Among these, the movable magnetic core portion 223 becomes the second beam 22 which moves in response to magnetization/magnetization loss.

The fixed magnetic core portion 221 and the movable magnetic core portion 223 have substantially an L-shape. A magnetic core portion of the flexible magnetic core portion 222 provided between the fixed magnetic core portion 221 and the movable magnetic core portion 223 (disposed near the center of the second magnetic core portion 220 in the longitudinal direction) is subjected to bending. The flexible magnetic core portion 222 has a shape which can be warped when the movable magnetic core portion 223 of the second magnetic core portion 220 receives an external force in a direction intersecting the extending direction thereof. Therefore, even when the movable magnetic core portion 223 which can freely move with respect to the circuit board P moves, the flexible magnetic core portion 222 regulates the fixed magnetic core portion 221 moving in response to the movement thereof. The shapes of the fixed magnetic core portion 221, the flexible magnetic core portion 222, and the movable magnetic core portion 223 are not limited to those illustrated in FIG. 2 and can be suitably changed.

The length of the second magnetic core portion 220 in the longitudinal direction (direction in which the fixed magnetic core portion 221, the flexible magnetic core portion 222, and the movable magnetic core portion 223 are arranged) is set within a range of approximately 100 μm to 1 mm, for example. The width (length in a direction perpendicular to the surface of the circuit board P in FIG. 2) is set within a range of approximately 5 μm to 100 μm, for example. The thickness (length in a direction parallel to the surface of the circuit board P in FIG. 2) is set within a range of approximately 1 μm to 10 μm, for example.

An insulator 231 partially covers a portion around the fixed magnetic core portion 221. In addition, a second coil portion 211 formed of a conductor such as copper (Cu) is provided on an outer side of the insulator 231 in a manner of being wound around the fixed magnetic core portion 221. In the magnetically actuated MEMS switch 100, the second coil portion 211 is wound around the fixed magnetic core portion 221 twice. However, the number of winding of the second coil portion 211 can be suitably changed. Both end portions of the second coil portion 211 serve as a conductor pad 212, which can be connected to a circuit or the like of the circuit board P. The thickness of the insulator 231 (length from an inner circumferential surface to an outer circumferential surface) is set within a range of approximately 1 μm to 10 μm, for example.

The second contact point 26 is provided in one end portion the movable magnetic core portion 223 (one end: an end portion on a side opposite to the other end which is the end portion on the flexible magnetic core portion 222 side). The size of the second contact point 26 is set within a range of approximately 5 square μm to 100 square μm, for example.

The second signal line 25 extends along the fixed magnetic core portion 221, the flexible magnetic core portion 222, and the movable magnetic core portion 223 and is provided to be electrically connected to the second contact point 26. In the case of the magnetically actuated MEMS switch 100, the second signal line 25 is provided along the outer side of the second magnetic core portion 220 (side opposite to a side facing the second driving unit SP2). The end portion of the second signal line 25 (end portion on a side opposite to the end portion on the second contact point 26 side) serves as a conductor pad 251, to which a circuit or the like of the circuit board P can be connected. An insulator 232 is provided between the second signal line 25 and the second magnetic core portion 220 and between the second contact point 26 and the second magnetic core portion 220 (movable magnetic core portion 223). The second signal line 25 and the second contact point 26 are electrically insulated from the second magnetic core portion 220. The thickness of the insulator 232 (length in a direction parallel to the surface of the circuit board P in FIG. 2) is set within a range of approximately 1 μm to 10 μm, for example. The second signal line 25 is disposed to avoid a position at which the second coil portion 211 is provided. However, the second signal line 25 may be wired such that the second coil portion 211 is wound around the second signal line 25. In addition, disposition of the second signal line 25 can be suitably changed. For example, the second signal line 25 may be wired on the inner side of the second magnetic core portion 220 (side facing the first driving unit SP1).

In the second driving unit SP2, the second coil portion 211 functions as the second magnetic field applying portion 21 which causes magnetization/magnetization loss of the second magnetic core portion 220 including the movable magnetic core portion 223 which functions as the second beam 22.

As illustrated in FIG. 2, the first contact point 16 attached to one end of the first magnetic core portion 120 of the first driving unit SP1 and the second contact point 26 attached to one end of the second magnetic core portion 220 of the second driving unit SP2 are disposed to face each other.

In the magnetically actuated MEMS switch 100 described above, in a state in which the first magnetic core portion 120 and the second magnetic core portion 220 are not magnetized (magnetization-loss state), the first contact point 16 and the second contact point 26 are in a state of being separated from each other. Therefore, the first signal line 15 and the second signal line 25 are disconnected from each other.

On the other hand, if a current flows in the first coil portion 111, a magnetic field is formed. The first magnetic core portion 120 is magnetized due to the influence of this magnetic field. As a result, magnetic poles of S pole/N pole are manifested at both ends of the first magnetic core portion 120. Similarly, if a current flows in the second coil portion 211, a magnetic field is formed. The second magnetic core portion 220 is magnetized due to the influence of this magnetic field. As a result, magnetic poles of S pole/N pole are manifested at both ends of the second magnetic core portion 220.

The direction of a current flowing in the first coil portion 111 and the second coil portion 211 is controlled, so that the polarity of the magnetic pole manifested in the end portion of the first magnetic core portion 120 on a side to which the first contact point 16 is attached (end portion on the movable magnetic core portion 123 side) and the polarity of the magnetic pole manifested in the end portion of the second magnetic core portion 220 on a side to which the second contact point 26 is attached (end portion on the movable magnetic core portion 223 side) can differ from each other. In this manner, if the polarity of the magnetic pole manifested in the end portion of the first magnetic core portion 120 on the movable magnetic core portion 123 side and the polarity of the magnetic pole manifested in the end portion of the second magnetic core portion 220 on the movable magnetic core portion 223 side differ from each other, the first magnetic core portion 120 and the second magnetic core portion 220 attract each other while they are magnetized.

As a result, the position of each of the first contact point 16 attached to the first magnetic core portion 120 and the second contact point 26 attached to the second magnetic core portion 220 is changed. The first contact point 16 and the second contact point 26 move in a direction of being close to each other along a horizontal direction (direction along the surface of the circuit board P) and come into contact with each other. If the first contact point 16 and the second contact point 26 come into contact with each other, the first signal line 15 and the second signal line 25 are electrically connected to each other.

In addition, if a current flowing in the first coil portion 111 and the second coil portion 211 is stopped (supplying of a current from the power supply is blocked), the first magnetic core portion 120 and the second magnetic core portion 220 lose magnetization. Therefore, the first magnetic core portion 120 and the second magnetic core portion 220 no longer attract each other, so that the first contact point 16 attached to the first magnetic core portion 120 and the second contact point 26 attached to the second magnetic core portion 220 are separated from each other, and each of the first contact point 16 and the second contact point 26 returns to the original position. If the first contact point 16 and the second contact point 26 are separated from each other, the first signal line 15 and the second signal line 25 are electrically disconnected from each other.

In order to realize the operation described above, there is a need for the first magnetic core portion 120 and the second magnetic core portion 220 to be disposed to be close to each other in the end portions on a side to which the first contact point 16 and the second contact point 26 are attached, to the extent that both attract each other by receiving a magnetic field formed by a magnetic core different from the self-magnetic core when being magnetized. The distance between the first contact point 16 and the second contact point 26 in a magnetization-loss state is set in accordance with the magnitude of a magnetic field (magnetic flux density) when the first magnetic core portion 120 and the second magnetic core portion 220 are magnetized.

The magnetically actuated MEMS switch 100 described above can be manufactured by suitably combining known film forming processes (photolithography, sputtering, CVD, plating, dry and wet etching, and sputtering), for example. The first coil portion 111 and the second coil portion 211 including a conductor coil can also be manufactured by combining lamination (film forming) and etching of each portion. The first coil portion 111 and the second coil portion 211 including a conductor coil may be formed by winding a conductor material after other parts of the magnetically actuated MEMS switch 100 are formed by utilizing the film forming process. In this manner, the magnetically actuated MEMS switch 100 may be manufactured by combining a known film forming process and other processes.

In the magnetically actuated MEMS switch 100 described above, a magnetic field applied to a first magnetic core portion 110 and a second magnetic core portion 210 is controlled by using the magnetic field applying portions including a conductor coil (the first magnetic field applying portion 11 and the second magnetic field applying portion 21). As a result, the first contact point 16 and the second contact point 26 are displaced, so that connection and disconnection between the first contact point 16 fixed to the first magnetic core portion 110 and the second contact point 26 fixed to the second magnetic core portion 210 are switched. Therefore, even if a mechanism or the like for moving an external magnet and magnetizing a magnetic material is not provided as in MEMS switches in the related art, connection and disconnection between the first contact point 16 and the second contact point 26 can be controlled, so that miniaturization can be realized.

In addition, in the magnetically actuated MEMS switch 100 described above, a magnetic field applied to the first magnetic core portion 110 and the second magnetic core portion 210 is controlled by utilizing supplying and blocking of a current with respect to the magnetic field applying portions (the first magnetic field applying portion 11 and the second magnetic field applying portion 21). Therefore, compared to magnetization/magnetization loss of a magnetic material utilizing an external magnet or the like, a magnetic field can be switched fast. Therefore, a switching operation can be promptly and accurately performed. Therefore, the magnetically actuated MEMS switch 100 can realize fast switching. In addition, according to a configuration in which a magnetic field is changed by supplying and blocking of a current instead of gradually changing the magnitude of a magnetic field, it is possible to prevent so-called sticking in which contact points come into contact with each other. In addition, if sticking occurs between contact points, the sticking can be resolved by causing a current such as a direct current, an alternating current, a high-frequency alternating current, or a pulse to flow such that a magnetic field is generated in both coils repelling both the contact points, respectively.

In addition, in the magnetically actuated MEMS switch 100, the flexible magnetic core portion 122 having flexibility is provided between both end portions of the first magnetic core portion 120. In such a configuration, when one end (movable magnetic core portion 123 side) to which the first contact point 16 is fixed due to a magnetic field applied by the magnetic field applying portion (first magnetic field applying portion 11) is displaced, the other end (fixed magnetic core portion 121 side) can be prevented from being displaced in response to this displacement. Therefore, it is possible to employ a structure different from a structure in which the first magnetic core portion 120 in its entirety is displaced due to an applied magnetic field. Accordingly, for example, the degree of freedom of design related to disposition or the like of a magnetically actuated MEMS switch can be enhanced.

In addition, in the magnetically actuated MEMS switch 100, the second contact point 26 fixed to the second magnetic core portion 220 is displaced depending on the presence or absence of a magnetic field applied by the magnetic field applying portion. That is, connection and disconnection between the first contact point 16 and the second contact point 26 are switched in response to the displacement of the first contact point 16 and the second contact point 26. In such a configuration, even if a displacement amount of each of the first contact point 16 and the second contact point 26 is small, connection and disconnection between the first contact point 16 and the second contact point 26 can be switched. Therefore, even when the magnitude of a magnetic field to be applied to the first magnetic core portion 120 and the second magnetic core portion 220 is reduced, connection and disconnection between the first contact point 16 and the second contact point 26 can be favorably switched. Moreover, according to a configuration in which both the first contact point 16 and the second contact point 26 are displaced, the movement distance of each of the contact points within which these contact points come into contact with each other and return to original positions becomes half, so that faster switching can be realized.

In addition, as in the magnetically actuated MEMS switch 100, in a case in which the flexible magnetic core portion 222 having flexibility is provided between both end portions of the second magnetic core portion 220, when one end (movable magnetic core portion 223 side) to which the second contact point 26 is fixed due to a magnetic field applied by the magnetic field applying portion (second magnetic field applying portion 21) is displaced, the other end (fixed magnetic core portion 221 side) can be prevented from being displaced in response to this displacement. Therefore, it is possible to employ a structure different from a structure in which the second magnetic core portion 220 in its entirety is displaced due to an applied magnetic field. Accordingly, for example, the degree of freedom of design related to disposition or the like of a magnetically actuated MEMS switch can be enhanced.

In addition, according to the aspect of the invention, in the magnetically actuated MEMS switch 100 described above, the first contact point 16 and the second contact point 26 may be separated from each other when there is no magnetic field applied by the magnetic field applying portion and they may come into contact with each other when there is a magnetic field applied by the magnetic field applying portion. In such a configuration, the first contact point 16 and the second contact point 26 can be connected to each other fast due to an applied magnetic field.

The shape of the magnetically actuated MEMS switch can be suitably changed. For example, in the magnetically actuated MEMS switch 100, the first contact point 16 and the second contact point 26 move in a direction of being close to each other along the horizontal direction (direction along the surface of the circuit board P) and come into contact with each other. However, the moving directions of the first contact point 16 and the second contact point 26 can be suitably changed. The moving directions of the first contact point 16 and the second contact point 26 are changed depending on the dispositions and the shapes of the first magnetic core portion 120 and the second magnetic core portion 220.

Figure 3:
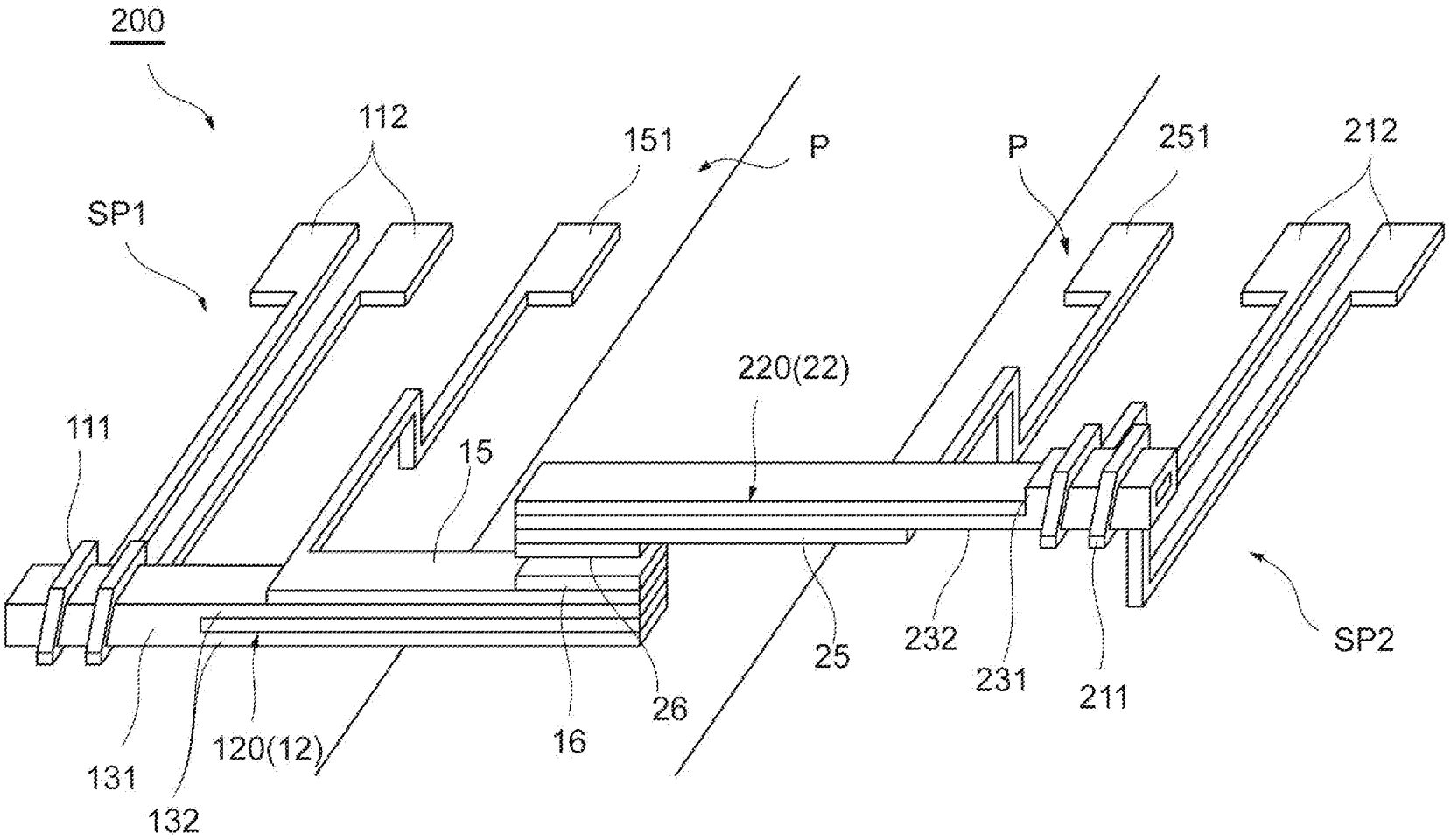
FIG. 3 is a perspective view of a magnetically actuated MEMS switch according to a modification example.

FIG. 3 is a perspective view of a magnetically actuated MEMS switch 200 according to a modification example. In the magnetically actuated MEMS switch 200, each of the first contact point 16 on the first driving unit SP1 side and the second contact point 26 on the second driving unit SP2 side moves along a vertical direction (direction perpendicular to the surface of the circuit board P), so that connection and disconnection between the first contact point 16 and the second contact point 26 are switched. In addition, compared to the magnetically actuated MEMS switch 100, in the magnetically actuated MEMS switch 200, the first magnetic core portion and the second magnetic core portion include no configuration corresponding to a flexible magnetic core portion.

In the magnetically actuated MEMS switch 200, each of the first magnetic core portion 120 and the second magnetic core portion 220 has an I-shape and is in a state of being separated from the circuit board P. In the magnetically actuated MEMS switch 200, the conductor pad 112 which is continuously provided with respect to the first coil portion 111 wound around the first magnetic core portion 120, the conductor pad 151 of the first signal line 15, the conductor pad 212 which is continuously provided with respect to the second coil portion 211 wound around the second magnetic core portion 220, and the conductor pad 251 of the second signal line 25 are fixed to the circuit board P. Each of the first magnetic core portion 120 and the second magnetic core portion 220 has a flat plate shape in which a surface parallel to the surface of the circuit board P becomes a main surface.

The first magnetic core portion 120 is in an interposed state between a pair of insulators 132. In addition, the first signal line 15 and the first contact point 16 are fixed to an upper surface of one end on a side to which the insulator 132 is attached on the main surface of the first magnetic core portion 120. The first signal line 15 and the first contact point 16 are laminated on the upper surface of the first magnetic core portion 120 in this order with the insulator 132 interposed therebetween. The insulator 132 does not have to be provided on a lower surface side of the first magnetic core portion 120.

The first coil portion 111 is wound around the first magnetic core portion 120 along the surface of the insulator 131 at the other end on a side opposite to one end at which the first contact point 16 is provided in the first magnetic core portion 120, in a state in which the insulator 131 covers a portion around the first magnetic core portion 120 (or a state in which the first magnetic core portion 120 is interposed therebetween). When the first magnetic core portion 120 is partially exposed, it is preferable that the first coil portion 111 and the first magnetic core portion 120 be separated from each other such that they do not come into contact with each other.

On the other hand, the second signal line 25 and the second contact point 26 are fixed to one end on a lower surface (end portion on the first magnetic core portion 120 side) of the main surface of the second magnetic core portion 220, with the insulator 232 interposed therebetween. The insulator 232, the second signal line 25, and the second contact point 26 are laminated on the lower surface of the second magnetic core portion 220 in this order.

The second coil portion 211 is wound around the second magnetic core portion 220 along the surface of the insulator 231 at the other end on a side opposite to one end at which the second contact point 26 is provided in the second magnetic core portion 220, in a state in which the insulator 231 covers a portion around the second magnetic core portion 220 (or a state in which the second magnetic core portion 220 is interposed therebetween). When the second magnetic core portion 220 is partially exposed, it is preferable that the second coil portion 211 and the second magnetic core portion 220 be separated from each other such that they do not come into contact with each other.

The first driving unit SP1 and the second driving unit SP2 are disposed such that the first contact point 16 and the second contact point 26 overlap each other in the vertical direction (direction perpendicular to the surface of the circuit board P).

As illustrated in FIG. 3, one of the first magnetic core portion 120 and the second magnetic core portion 220 described above may be provided on a support base or the like. In this case, for example, the support base can be disposed on the end portion side of the magnetic core portion around which the coil portion (first coil portion 111 or the second coil portion 211) is wound. However, the disposition or the attachment structure of the support base is not particularly limited.

In the magnetically actuated MEMS switch 200 described above, in a state in which the first magnetic core portion 120 and the second magnetic core portion 220 are not magnetized (magnetization-loss state), the first contact point 16 and the second contact point 26 are in a state of being separated from each other. Therefore, the first signal line 15 and the second signal line 25 are disconnected from each other.

On the other hand, if a current flows in the first coil portion 111, a magnetic field is formed. The first magnetic core portion 120 is magnetized due to the influence of this magnetic field. As a result, magnetic poles of S pole/N pole are manifested at both ends of the first magnetic core portion 120. Similarly, if a current flows in the second coil portion 211, a magnetic field is formed. The second magnetic core portion 220 is magnetized due to the influence of this magnetic field. As a result, magnetic poles of S pole/N pole are manifested at both ends of the second magnetic core portion 220.

When the direction of a current flowing in the first coil portion 111 and the second coil portion 211 is controlled, the polarity of the magnetic pole manifested in the end portion of the first magnetic core portion 120 on a side to which the first contact point 16 is attached and the polarity of the magnetic pole manifested in the end portion of the second magnetic core portion 220 on a side to which the second contact point 26 is attached can differ from each other. Accordingly, while the first magnetic core portion 120 and the second magnetic core portion 220 are magnetized, these attract each other.

As a result, the position of each of the first contact point 16 attached to the first magnetic core portion 120 and the second contact point 26 attached to the second magnetic core portion 220 is changed. The first contact point 16 and the second contact point 26 move in a direction of being close to each other along the vertical direction (direction perpendicular to the surface of the circuit board P) and come into contact with each other. If the first contact point 16 and the second contact point 26 come into contact with each other, the first signal line 15 and the second signal line 25 are electrically connected to each other.

In addition, if a current flowing in the first coil portion 111 and the second coil portion 211 is stopped (supplying of a current from the power supply is blocked), the first magnetic core portion 120 and the second magnetic core portion 220 lose magnetization. Therefore, the first magnetic core portion 120 and the second magnetic core portion 220 no longer attract each other, so that the first contact point 16 attached to the first magnetic core portion 120 and the second contact point 26 attached to the second magnetic core portion 220 are separated from each other, and each of the first contact point 16 and the second contact point 26 returns to the original position. If the first contact point 16 and the second contact point 26 are separated from each other, the first signal line 15 and the second signal line 25 are electrically disconnected from each other.

In this manner, in the magnetically actuated MEMS switch 200 as well, a magnetic field applied to a first magnetic core portion 110 and a second magnetic core portion 210 is controlled by using the magnetic field applying portions including a conductor coil (the first magnetic field applying portion 11 and the second magnetic field applying portion 21). As a result, the first contact point 16 and the second contact point 26 are displaced, so that connection and disconnection between the first contact point 16 fixed to the first magnetic core portion 110 and the second contact point 26 fixed to the second magnetic core portion 210 are switched.

In the magnetically actuated MEMS switch 200, since neither the first magnetic core portion 120 nor the second magnetic core portion 220 has a flexible magnetic core portion, when the first magnetic core portion 120 and the second magnetic core portion 220 attract each other, each of the first magnetic core portion 120 and the second magnetic core portion 220 moves without being deformed. Therefore, there is a possibility that the first signal line 15, the first coil portion 111, the second signal line 25, the second coil portion 211, and the like will receive stress in response to the displacement of the first magnetic core portion 120 and the second magnetic core portion 220. In this regard, the magnetically actuated MEMS switch 200 may have a configuration provided with a region or the like in which stress can be alleviated by devising at least the shapes of the first signal line 15, the first coil portion 111, the second signal line 25, the second coil portion 211, and the like.

As in the magnetically actuated MEMS switch 100 and the magnetically actuated MEMS switch 200, the shape of the magnetically actuated MEMS switch according to the present embodiment can be suitably changed.

Figure 4B:
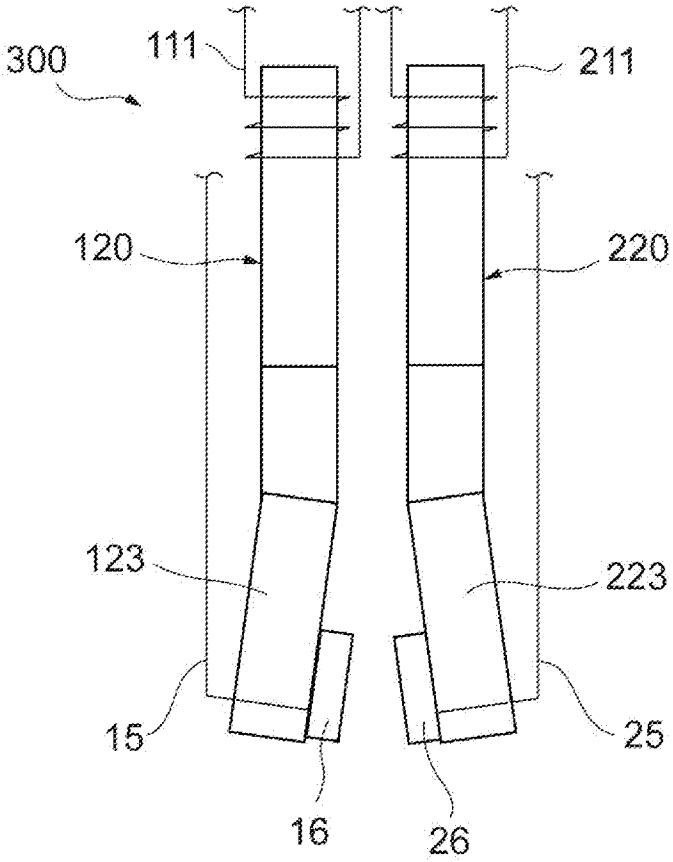
FIGS. 4A and 4B are a schematic view of a magnetically actuated MEMS switch according to another modification example.
Figure 4A:
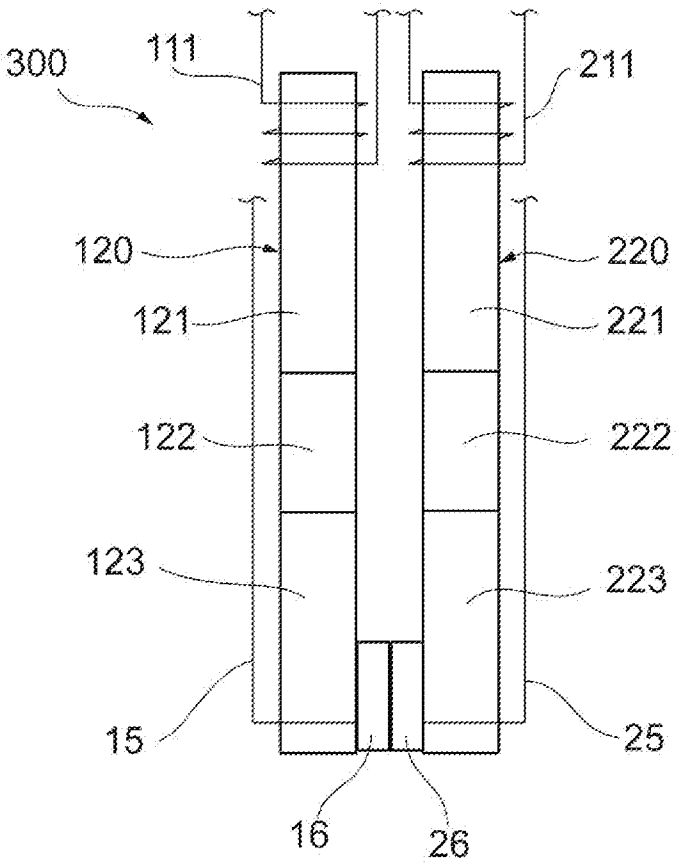
Figure 5:
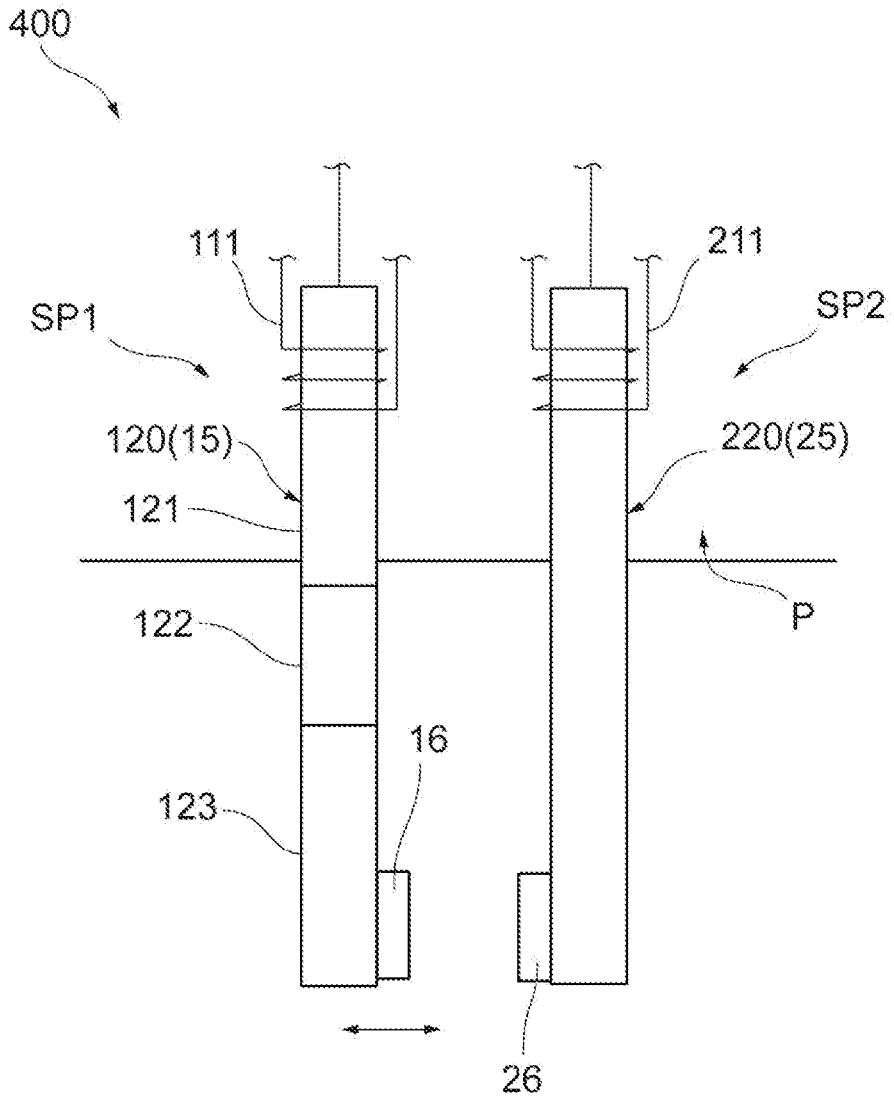
FIG. 5 is a schematic view of a magnetically actuated MEMS switch according to another modification example.

FIGS. 4A, 4B and 5 are views schematically illustrating modification examples of the magnetically actuated MEMS switch according to the present embodiment.

FIGS. 4A and 4B illustrate an example of a magnetically actuated MEMS switch having a structure in which a first contact point and a second contact point are separated from each other when a magnetic field is applied by a magnetic field applying portion. FIG. 4A is a view illustrating a state in which no magnetic field is applied to the first magnetic core portion 120 and the second magnetic core portion 220 of a magnetically actuated MEMS switch 300. FIG. 4B is a view illustrating a state in which a magnetic field is applied to the first magnetic core portion 120 and the second magnetic core portion 220 of the magnetically actuated MEMS switch 300.

As illustrated in FIG. 4A, in the magnetically actuated MEMS switch 300, the first contact point 16 and the second contact point 26 are brought into contact with each other in a state in which no magnetic field is applied by the first coil portion 111 serving as a first magnetic field applying portion and the second coil portion 211 serving as a second magnetic field applying portion. In this state, a current is caused to flow in the first coil portion 111 and the second coil portion 211, and a magnetic field is formed, such that the first magnetic core portion 120 and the second magnetic core portion 220 are magnetized. In this case, the direction of a current flowing in the first coil portion 111 and the second coil portion 211 is controlled, such that the polarity of the magnetic pole manifested in the end portion of the first magnetic core portion 120 on a side to which the first contact point 16 is attached (end portion on the movable magnetic core portion 123 side) and the polarity of the magnetic pole manifested in the end portion of the second magnetic core portion 220 on a side to which the second contact point 26 is attached (end portion on the movable magnetic core portion 223 side) become the same as each other. In this manner, if the polarity of the magnetic pole manifested in the end portion of the first magnetic core portion 120 on the movable magnetic core portion 123 side and the polarity of the magnetic pole manifested in the end portion of the second magnetic core portion 220 on the movable magnetic core portion 223 side are the same as each other, the first magnetic core portion 120 and the second magnetic core portion 220 repel each other while they are magnetized.

As a result, as illustrated in FIG. 4B, the position of each of the first contact point 16 attached to the first magnetic core portion 120 and the second contact point 26 attached to the second magnetic core portion 220 changes, so that the first contact point 16 and the second contact point 26 move in a direction of being separated from each other. Therefore, the first contact point 16 and the second contact point 26 are separated from each other, and the first signal line 15 and the second signal line 25 are electrically disconnected from each other.

In addition, if a current flowing in the first coil portion 111 and the second coil portion 211 is stopped (supplying of a current from the power supply is blocked), the first magnetic core portion 120 and the second magnetic core portion 220 lose magnetization, so that each of the first contact point 16 attached to the first magnetic core portion 120 and the second contact point 26 attached to the second magnetic core portion 220 returns to the original position. At the original position, as illustrated in FIG. 4A, the first contact point 16 and the second contact point 26 come into contact with each other, and the first signal line 15 and the second signal line 25 are electrically connected to each other.

According to the aspect of the invention, as in the magnetically actuated MEMS switch 300 illustrated in FIGS. 4A and 4B, the first contact point 16 and the second contact point 26 may be separated from each other when there is a magnetic field applied by the first coil portion 111 and the second coil portion 211 serving as a magnetic field applying portion and they may come into contact with each other when there is no applied magnetic field.

FIG. 5 illustrates a magnetically actuated MEMS switch 400 in which the second driving unit SP2 is fixed to the circuit board P.

In the magnetically actuated MEMS switch 400, similar to the magnetically actuated MEMS switch 300, a structure on the first driving unit SP1 side is basically configured to include the fixed magnetic core portion 121, the flexible magnetic core portion 122, and the movable magnetic core portion 123. However, the first magnetic core portion 120 functions as the first signal line 15. That is, the first magnetic core portion 120 has conductivity, and the first contact point 16 is connected to the first magnetic core portion 120. Therefore, a signal input from outside reaches the first contact point 16 through the first magnetic core portion 120.

On the other hand, the second driving unit SP2 is constituted of the rod-shaped second magnetic core portion 220 fixed to the circuit board P but does not include a flexible magnetic core portion having flexibility. Therefore, the second magnetic core portion 220 is in a state of being fixed to the circuit board P and does not move even when a current flows in the second coil portion 211 and a polarity is manifested in the second magnetic core portion 220. In addition, even in the second driving unit SP2 as well, similar to the first driving unit SP1, the second magnetic core portion 220 functions as the second signal line 25. That is, the second magnetic core portion 220 has conductivity, and the second contact point 26 is connected to the second magnetic core portion 220. Therefore, a signal input from outside reaches the second contact point 26 through the second magnetic core portion 220.

In the magnetically actuated MEMS switch 400 illustrated in FIG. 5, the second driving unit SP2 is fixed to the circuit board P as described above. However, similar to other magnetically actuated MEMS switches, in the first driving unit SP1, the first contact point 16 is displaced depending on the presence or absence of a magnetic field. Therefore, similar to other magnetically actuated MEMS switches, switching based on the presence or absence of an applied magnetic field can be performed. That is, in a state in which the first magnetic core portion 120 and the second magnetic core portion 220 are not magnetized (magnetization-loss state), the first contact point 16 and the second contact point 26 are in a state of being separated from each other. Therefore, the first signal line 15 (first magnetic core portion 120) and the second signal line 25 (second magnetic core portion 220) are disconnected from each other.

On the other hand, if a current is caused to flow in the first coil portion 111 and the second coil portion 211, and the first magnetic core portion 120 and the second magnetic core portion 220 are magnetized such that the polarity of the magnetic pole manifested in the end portion of the first magnetic core portion 120 on the movable magnetic core portion 123 side and the polarity of the magnetic pole manifested in the end portion of the second magnetic core portion 220 on the movable magnetic core portion 223 side differ from each other, the first magnetic core portion 120 and the second magnetic core portion 220 attract each other while they are magnetized. As a result, if the first contact point 16 moves to the second magnetic core portion 220 side, and the first contact point 16 and the second contact point 26 come into contact with each other, the first signal line 15 (first magnetic core portion 120) and the second signal line 25 (second magnetic core portion 220) are electrically connected to each other.

In addition, if a current flowing in the first coil portion 111 and the second coil portion 211 is stopped (supplying of a current from the power supply is blocked), the first magnetic core portion 120 and the second magnetic core portion 220 lose magnetization. Therefore, the first magnetic core portion 120 and the second magnetic core portion 220 no longer attract each other, so that the first contact point 16 attached to the first magnetic core portion 120 is separated from the second contact point 26 attached to the second magnetic core portion 220 and returns to the original position. If the first contact point 16 and the second contact point 26 are separated from each other, the first signal line 15 (first magnetic core portion 120) and the second signal line 25 (second magnetic core portion 220) are electrically disconnected from each other.

As in a magnetically actuated MEMS switch 500 illustrated in FIG. 5, even when a magnetic core portion (second magnetic core portion 220) of one driving unit (second driving unit SP2 in the example illustrated in FIG. 5) is fixed so that the contact point (second contact point 26) cannot be displaced, if the first contact point 16 fixed to a magnetic core portion (first magnetic core portion 120) of the other driving unit can be displaced, connection/disconnection between the first signal line 15 and the second signal line 25 can be switched.

In addition, as in the magnetically actuated MEMS switch 400, the first magnetic core portion 120 may function as the first signal line 15. Similarly, the second magnetic core portion 220 may function as the second signal line 25.

The first magnetic core portion 120 may function as the first contact point 16. Similarly, the second magnetic core portion 220 may function as the second contact point 26. In this case, if the first magnetic core portion 120 functioning as the first contact point 16 and the second magnetic core portion 220 functioning as the second contact point 26 come into contact with each other such that the first signal line 15 and the second signal line are electrically connected to each other and the first magnetic core portion 120 and the second magnetic core portion 220 are separated from each other, the first signal line 15 and the second signal line are electrically disconnected from each other.

In addition to the modification examples described above, the shape of the magnetically actuated MEMS switch according to the present embodiment can be suitably changed.

For example, the winding direction of the first coil portion 111 and the second coil portion 211 functioning as magnetic field applying portions can be suitably changed. Even if methods of winding a coil portion are different from each other, the polarity manifested in the end portion of the magnetic core portion can be controlled by controlling the direction of a current flowing in the coil portion.

In addition, a plurality of coil portions may be attached to the magnetic core portion (first magnetic core portion 120 or the second magnetic core portion 220). In addition, a configuration in which one coil portion (for example, the first coil portion 111) applies a magnetic field to both of two magnetic core portions (first magnetic core portion 120 and the second magnetic core portion 220) may be adopted. For example, in the magnetically actuated MEMS switch 100 illustrated in FIG. 2, the end portion of the first magnetic core portion 120 (end portion of the fixed magnetic core portion 121) around which the first coil portion 111 is wound and the end portion of the fixed magnetic core portion 221 of the second magnetic core portion 220 are disposed to be close to each other. In such a case, if a current is caused to flow in the first coil portion 111 such that the first magnetic core portion 120 is magnetized, the second magnetic core portion 220 can also be magnetized due to a magnetic field made by the first magnetic core portion 120. Therefore, two magnetic core portions (first magnetic core portion 120 and the second magnetic core portion 220) can be magnetized by using one coil (first coil portion 111). However, such a method has a configuration which can be applied to an MEMS switch in which the first contact point 16 and the second contact point 26 attract each other when being magnetized, as in the magnetically actuated MEMS switch 100.

In addition, the shapes or the dispositions of insulators provided around the first magnetic core portion 120 and the second magnetic core portion 220 can be suitably changed. In addition, the shapes and the dispositions of the first signal line 15, the first contact point 16, the second signal line 25, and the second contact point 26 can also be suitably changed.

In addition, in the magnetically actuated MEMS switch described above, a configuration in which one contact point is provided in each of the first magnetic core portion 120 and the second magnetic core portion 220 and connection and disconnection between these contact points are switched has been described. However, a configuration in which a plurality of sets of contact points (plurality of sets of a pair of contact points) are provided in the first magnetic core portion 120 and the second magnetic core portion 220 and connection and disconnection between the contact points of each set are switched may be adopted. In such a case, each of the contact points of the plurality of sets may be configured to switch contact and disconnection between signal lines different from each other or may be configured to switch contact and disconnection between the same signal lines.

Figure 6:
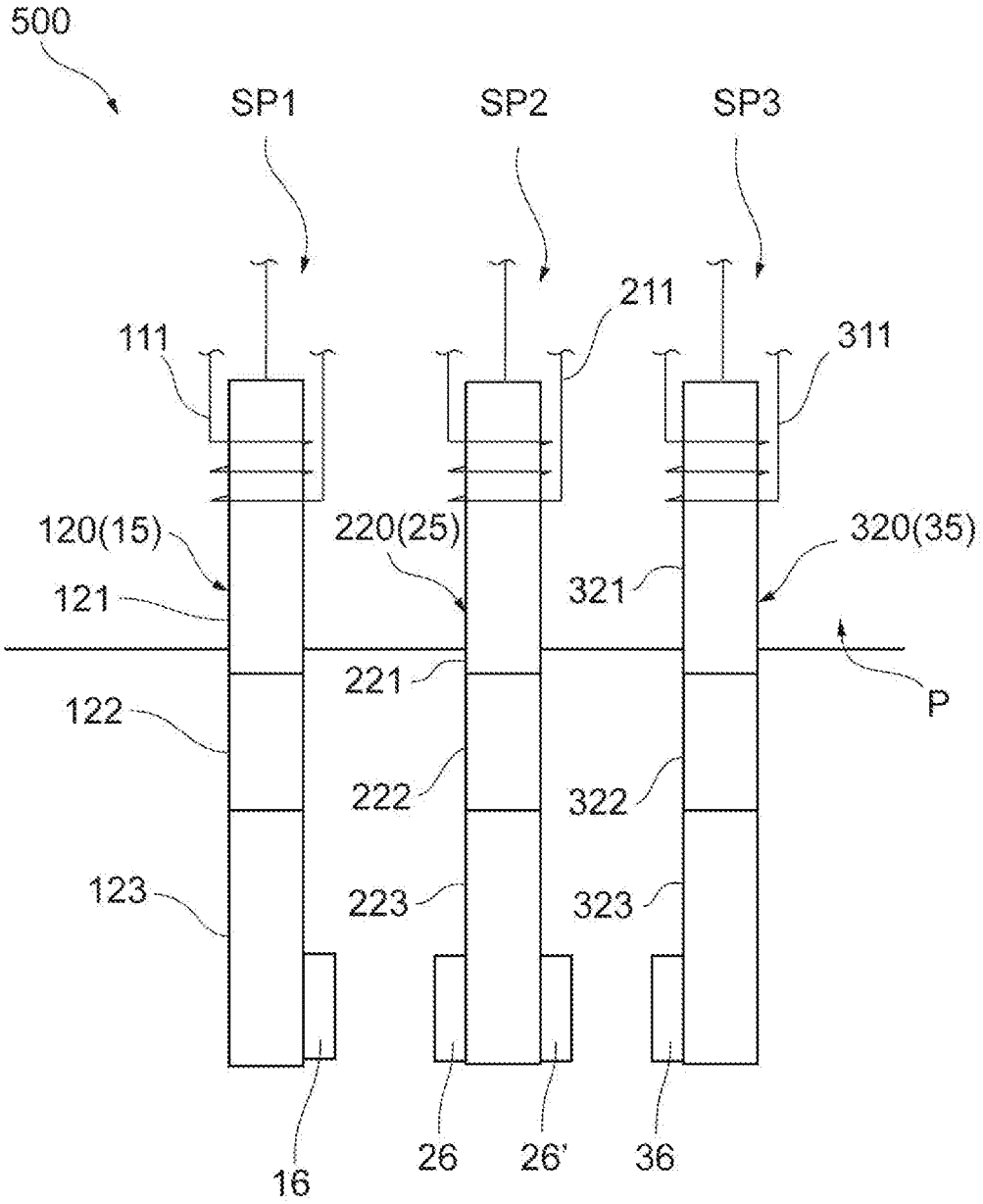
FIG. 6 is a schematic view of a magnetically actuated MEMS switch according to another modification example.

As a configuration according to the modification example, FIG. 6 illustrates the magnetically actuated MEMS switch 500 in which the first driving unit SP1, the second driving unit SP2, and a third driving unit SP3 serving as three driving units are fixed to the circuit board P.

All of the first driving unit SP1, the second driving unit SP2, and the third driving unit SP3 have a structure similar to that of the first driving unit SP1 of the magnetically actuated MEMS switch 400. However, the second driving unit SP2 has two contact points, that is, second contact points 26 and 26' on its both sides. Therefore, the first contact point 16 of the first driving unit SP1 and the second contact point 26 of the second driving unit SP2 face each other, and the second contact point 26' of the second driving unit SP2 and a third contact point 36 of the third driving unit SP3 face each other. The second contact points 26 and 26' are electrically connected to each other via the movable magnetic core portion 223.

In such a magnetically actuated MEMS switch 500, the presence or absence of a current and the direction of a current flowing in each of the first coil portion 111, the second coil portion 211, and a third coil portion 311 respectively wound around the first driving unit SP1, the second driving unit SP2, and the third driving unit SP3 are controlled, so that the magnetic field applied to the first driving unit SP1, the second driving unit SP2, and the third driving unit SP3 (that is, displacement of contact points of each driving unit) can be controlled. Accordingly, for example, it is possible to adopt a configuration in which only the second contact points 26 and 26' attached to the second magnetic core portion 220 of the second driving unit SP2 are moved to alternately switch contact between the second contact point 26 and the first contact point 16 which is attached to the first magnetic core portion 120 of the first driving unit SP1, and contact between the second contact point 26' and the third contact point 36 which is attached to a third magnetic core portion 320 of the third driving unit SP3.

In addition, for example, when the first contact point 16 which is attached to the first magnetic core portion 120 of the first driving unit SP1 and the third contact point 36 attached to the third magnetic core portion 320 of the third driving unit SP3 are configured to move and the second contact points 26 and 26' attached to the second magnetic core portion 220 of the second driving unit SP2 are configured not to move, for example, it is possible to adopt a configuration in which the second contact point 26 and the first contact point 16 which is attached to the first magnetic core portion 120 of the first driving unit SP1 come into contact with each other and the second contact point 26' and the third contact point 36 which is attached to the third magnetic core portion 320 of the third driving unit SP3 come into contact with each other at the same time, so that the first contact point 16 and the third contact point 36 can be electrically connected to each other via the second contact points 26 and 26' electrically connected to each other via the movable magnetic core portion 223.

In this manner, the number of driving units and contact points constituting a magnetically actuated MEMS switch can be suitably changed in accordance with its structure. In addition, the way of controlling connection/disconnection between contact points can also be suitably changed in accordance with a configuration of switching performed by using the magnetically actuated MEMS switch.

Figure 7:
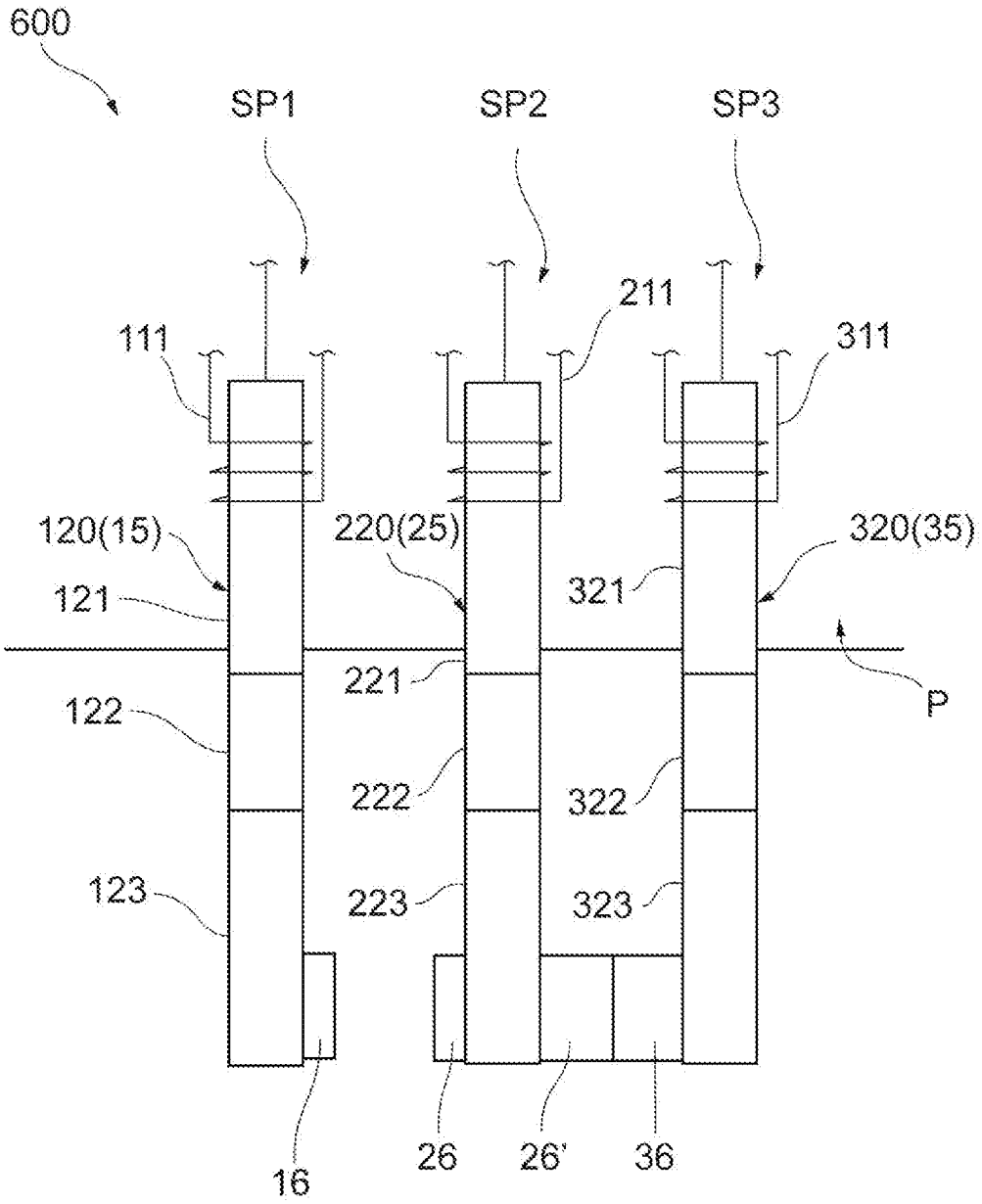
FIG. 7 is a schematic view of a magnetically actuated MEMS switch according to another modification example.

In a magnetically actuated MEMS switch 600 illustrated in FIG. 7, compared to the magnetically actuated MEMS switch 500, the thickness of the second contact point 26' and the third contact point 36 is changed, and both facing each other abut each other. In this case, the second contact point 26' and the third contact point 36 are configured to come into contact with each other in a state in which no current is flowing in the second coil portion 211 and the third coil portion 311 serving as a magnetic field applying portion, that is, when there is no magnetic field applied by the second coil portion 211 and the third coil portion 311. In addition, the second contact point 26' and the third contact point 36 are configured to be able to be separated from each other when there is a magnetic field applied in a predetermined direction. In the magnetically actuated MEMS switch 600 having a configuration, the presence or absence of a current and the direction thereof flowing in the coil portions of three driving units are controlled, so that switching different from that of the magnetically actuated MEMS switch 500 can be performed.

What is claimed is:

1. A magnetically actuated MEMS switch comprising:

a first magnetic core portion;

a first signal line that is provided in the first magnetic core portion;

a first contact point that is fixed to one end of the first magnetic core portion and is electrically connected to the first signal line;

a second magnetic core portion;

a second signal line that is provided in the second magnetic core portion;

a second contact point that is fixed to one end of the second magnetic core portion and is electrically connected to the second signal line; and a magnetic field applying portion that includes a conductor coil and causes a current to flow in the conductor coil such that a magnetic field is applied to the first magnetic core portion and the second magnetic core portion, wherein the first contact point is displaced depending on the presence or absence of a magnetic field applied by the magnetic field applying portion, and wherein connection and disconnection between the first contact point and the second contact point are switched in response to displacement of the first contact point.

2. The magnetically actuated MEMS switch according to claim 1, wherein the first magnetic core portion includes a flexible magnetic core portion that is provided between the one end to which the first contact point is fixed and the other end opposite to the one end, and that has flexibility with respect to an external force in a direction in which the one end intersects an extending direction of the one end.

3. The magnetically actuated MEMS switch according to claim 1, wherein the second contact point is displaced depending on the presence or absence of a magnetic field applied by the magnetic field applying portion, and wherein connection and disconnection between the first contact point and the second contact point are switched in response to displacement of the first contact point and the second contact point.

4. The magnetically actuated MEMS switch according to claim 3, wherein the second magnetic core portion includes a flexible magnetic core portion that is provided between the one end to which the second contact point is fixed and the other end opposite to the one end, and that has flexibility with respect to an external force in a direction in which the one end intersects an extending direction of the one end.

5. The magnetically actuated MEMS switch according to claim 1, wherein the first contact point and the second contact point are separated from each other when there is no magnetic field applied by the magnetic field applying portion and are electrically connected to each other when there is a magnetic field applied by the magnetic field applying portion.

6. The magnetically actuated MEMS switch according to claim 1, wherein the first contact point and the second contact point are separated from each other when there is a magnetic field applied by the magnetic field applying portion and are electrically connected to each other when there is no magnetic field applied by the magnetic field applying portion.

7. The magnetically actuated MEMS switch according to claim 1, wherein the first magnetic core portion functions as the first signal line, or the first signal line and the first contact point.

8. The magnetically actuated MEMS switch according to claim 1, wherein the second magnetic core portion functions as the second signal line, or the second signal line and the second contact point.

* * * * *